US005801323A

United States Patent [19]

Kerdraon

[11] Patent Number: 5,801,323

[45] Date of Patent: Sep. 1, 1998

[54] SHAPED-CHARGED WARHEAD AND MUNITION EQUIPPED WITH SUCH A WARHEAD

[75] Inventor: Alain Kerdraon, Bourges, France

[73] Assignee: Giat Industries, Versailles, France

[21] Appl. No.: 677,741

[22] Filed: Jul. 8, 1996

[30] Foreign Application Priority Data

Jul. 7, 1995 [FR] France ..... 95 08246

[51] Int. Cl.[6] ..... F42B 12/10

[52] U.S. Cl. ..... 102/476; 102/492; 102/501

[58] Field of Search ..... 102/305–310, 102/475, 476, 501, 701, 491, 492

[56] References Cited

U.S. PATENT DOCUMENTS

| | | | |
|---|---|---|---|
| H1504 | 12/1995 | Crabtree | 102/476 |
| B 397,527 | 1/1975 | Dunetz et al. . | |
| 4,297,946 | 11/1981 | Paton et al. | 102/307 |
| 4,612,859 | 9/1986 | Furch et al. . | |
| 4,922,825 | 5/1990 | Aubry et al. . | |
| 5,003,885 | 4/1991 | Rudolf et al. | 102/475 |
| 5,322,020 | 6/1994 | Bernard et al. | 102/476 |
| 5,349,908 | 9/1994 | Walz et al. | 102/476 |
| 5,524,546 | 6/1996 | Rozner et al. | 102/307 |

FOREIGN PATENT DOCUMENTS

| | | | |
|---|---|---|---|
| 159389 | 10/1985 | European Pat. Off. . | |
| 0477799 A1 | 4/1992 | European Pat. Off. . | |
| 2406800 | 5/1979 | France . | |
| 2590973 | 6/1987 | France . | |
| 2620215 | 3/1989 | France . | |
| 2632394 | 12/1989 | France . | |
| 3906098 | 9/1989 | Germany . | |
| 88 08 606 U | 12/1989 | Germany . | |
| 3920017 | 1/1991 | Germany | 102/476 |
| 2006400 | 5/1979 | United Kingdom . | |
| 2107032 | 4/1983 | United Kingdom . | |
| 2180042 | 3/1987 | United Kingdom | 102/476 |

*Primary Examiner*—Harold J. Tudor
*Attorney, Agent, or Firm*—Oliff & Berridge, PLC

[57] ABSTRACT

A shaped-charge warhead for munitions according to the invention includes a triggering mechanism and an explosive charge located inside an envelope and in contact with a covering designed to be set in motion in a direction of action by the detonation of the explosive charge. The envelope is essentially cylindrical and the covering is located such that the direction of action is essentially perpendicular to the axis of the envelope. The triggering mechanism is located in the vicinity of the cylindrical envelope and on the other side of the axis relative to the covering.

19 Claims, 6 Drawing Sheets

SHAPED-CHARGED WARHEAD AND MUNITION EQUIPPED WITH SUCH A WARHEAD

BACKGROUND OF THE INVENTION

The present invention relates to shaped-charge warheads for munitions.

French Pat. No. 2,632,394, for example, teaches a shaped-charge warhead that comprises a covering set in motion by the detonation of an explosive charge located in a cylindrical envelope. The covering is deformed into a core that is projected toward a target at a speed on the order of 2200 m/s. Shielded targets are especially vulnerable at the level of their upper parts, which is why an effort is made to design shaped-charge munitions whose direction of action is essentially vertical.

Munitions, such as rockets or missiles, are known from patents: France 2,406,800, Germany 3,906,098 and Great Britain 2,006,400 which act by overflying the objective and comprise a warhead whose axis of action is essentially normal to the axis of the munition, which is also the direction of flight of the munition. A munition of this kind has disadvantages. For example, the weight of explosives that can be included in the warhead is limited by the diameter of the munition. Since the warhead has a direction of action that is essentially normal to the axis of the munition, it is not possible to give it a diameter larger than 90% of that of the munition. In addition, the warhead generally has a cylindrical envelope, so that when a diameter is chosen, the height of the warhead is also limited by the diameter of the munition, and the height of the warhead also increases with the diameter chosen. Thus, it is not possible to equip such warheads with a large explosive charge, as their effectiveness will be reduced.

Warheads are also known (for example, from patents France 2,620,215, United States B397,527, Europe 159,389, Great Britain 2,107,032, German 8808606.2 and Europe 477,799) whose envelope can produce splinters or even projectiles that are scattered radially in several directions from the envelope. These charges are triggered at the axis of the envelope, thus ensuring axial symmetry of shock wave propagation. This symmetry makes it possible to confer a speed of the same order of magnitude on each splinter or projectile. The splinters are distributed in several regularly-distributed radial directions and therefore cannot all reach a target. The effectiveness and especially the perforation performance that can be obtained with such a charge are therefore reduced.

SUMMARY OF THE INVENTION

A goal of the invention is to propose a warhead that does not suffer from these disadvantages.

Thus the invention proposes a warhead that can be placed in a munition that has a direction of action essentially normal to the axis of the munition, with the warhead having a charge whose weight is greater than that of known warheads, and thus having a greater effectiveness.

One of the principal advantages of the invention is that, for a given caliber of munition, there is practically no limit imposed by this caliber on defining an effective warhead that has a direction of action that is essentially normal to the axis of the munition.

Thus, a goal of the invention is a shaped-charge warhead comprising a triggering mechanism and an explosive charge, located inside an envelope and in contact with a covering, designed to be set in motion in a direction of action by the detonation of the explosive charge, said warhead being characterized in that the envelope is essentially cylindrical and in that the covering is so disposed that the direction of action is essentially perpendicular to the axis of the envelope. The triggering mechanism is located in the vicinity of the cylindrical envelope on the other side of the axis relative to the covering.

According to a first embodiment, the covering has a convexity directed toward the axis of the envelope. In particular, it is possible to have a double convexity, a first convexity in a plane perpendicular to the axis of the envelope and a second convexity in a plane passing through the axis of the envelope.

According to a second embodiment, the covering has a concavity directed toward the axis of the envelope.

The covering advantageously includes a plane face. The covering can be delimited by surfaces with straight generatrices parallel to the axis of the envelope.

According to another embodiment, the covering comprises a concave face oriented towards the outside of the warhead, said face having a double concavity, a first concavity in a plane perpendicular to the axis of the envelope, and a second concavity in a plane passing through the axis of the envelope.

According to various characteristics: (i) the thickness of the covering can increase from its periphery furthest from the direction of action toward a central part that is closest to the direction of action; and (ii) the triggering mechanism comprises a plane wave generator using plate projection. The covering, for example, can be made of a material selected from the following nonexhaustive list: iron, copper, tantalum, nickel. The envelope is advantageously made of a composite material.

The invention also has as its goal a munition comprising such a warhead that comprises an axis that corresponds to its flight direction and an envelope that is essentially parallel to or coincident with the axis of the munition.

BRIEF DESCRIPTION OF THE DRAWINGS

The invention will be better understood from reading the following description of specific embodiments, with reference to the attached drawings, wherein.

DETAILED DESCRIPTION OF PREFERRED EMBODIMENTS

Figure 1:
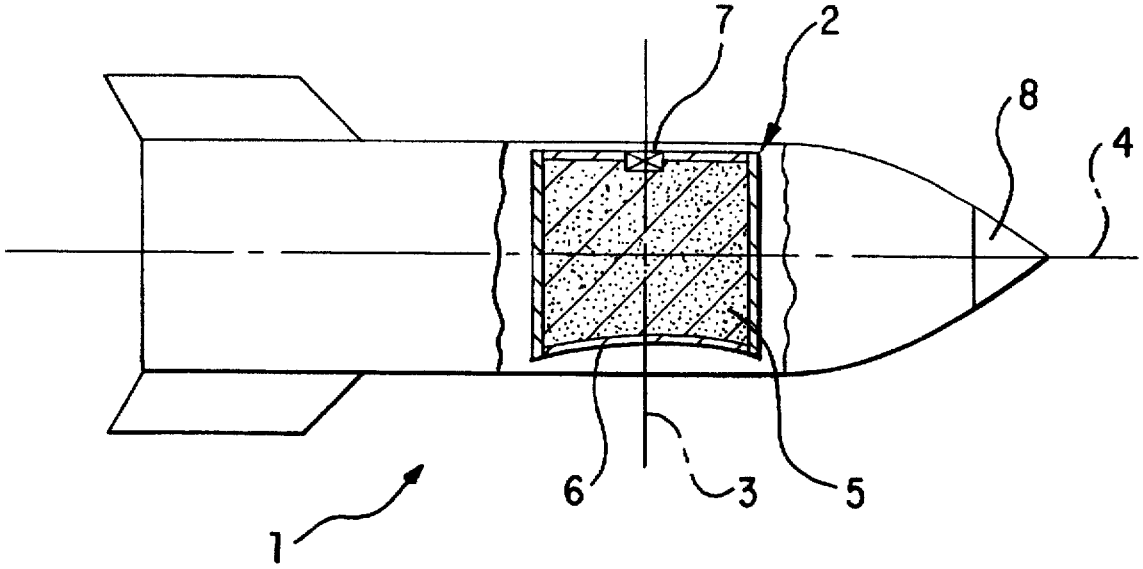
FIG. 1 PRIOR ART
FIG. 1 is a schematic diagram of a munition equipped with a warhead according to the prior art.

With reference to FIG. 1, a known munition 1 (a rocket for example) comprises a warhead 2 whose axis of action 3 is essentially perpendicular to lengthwise axis 4 of the munition. The known warhead comprises a cylindrical envelope whose axis is coincident with direction of action 3, with an explosive charge 5 being located inside said envelope, said charge being designed to set a covering 6 in motion. Explosive charge 5 is triggered by a triggering means 7 whose function is controlled by a fuse 8 of the munition. The fuse can be a fuse of known technology, for example, a radar and/or infrared proximity fuse that detects the overflying of a target (not shown) by munition 1. The. effectiveness of such a known munition is limited by the small quantity of explosives which can be placed in the warhead, the dimensions of said warhead being limited by the diameter of the body of the munition.

Figure 2:
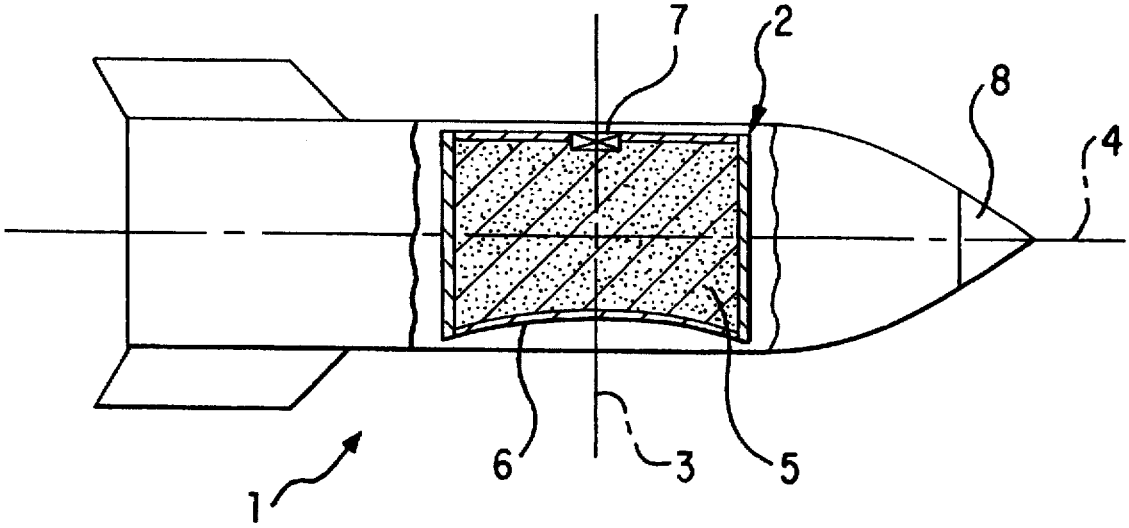
FIG. 2 is a schematic diagram of a munition equipped with a warhead according to the invention.

FIG. 2 shows a munition 1 according to the invention that differs from the previous munition in the particular structure of warhead 2. The warhead according to the invention still has a direction of action 3 essentially perpendicular to lengthwise axis 4 of the munition (which corresponds to the flight direction of said munition). However, the envelope containing explosive charge 5 no longer has a cylindrical shape with an axis that coincides with direction of action 3, but, on the contrary, has a cylindrical shape that is coincident with (or parallel to) axis 4 of the munition.

As a result, it is possible to place a larger quantity of explosive charge in the warhead. The dimensioning of said warhead is therefore no longer limited by the axial dimensions which it is possible to confer on it in the munition.

Figure 3A:
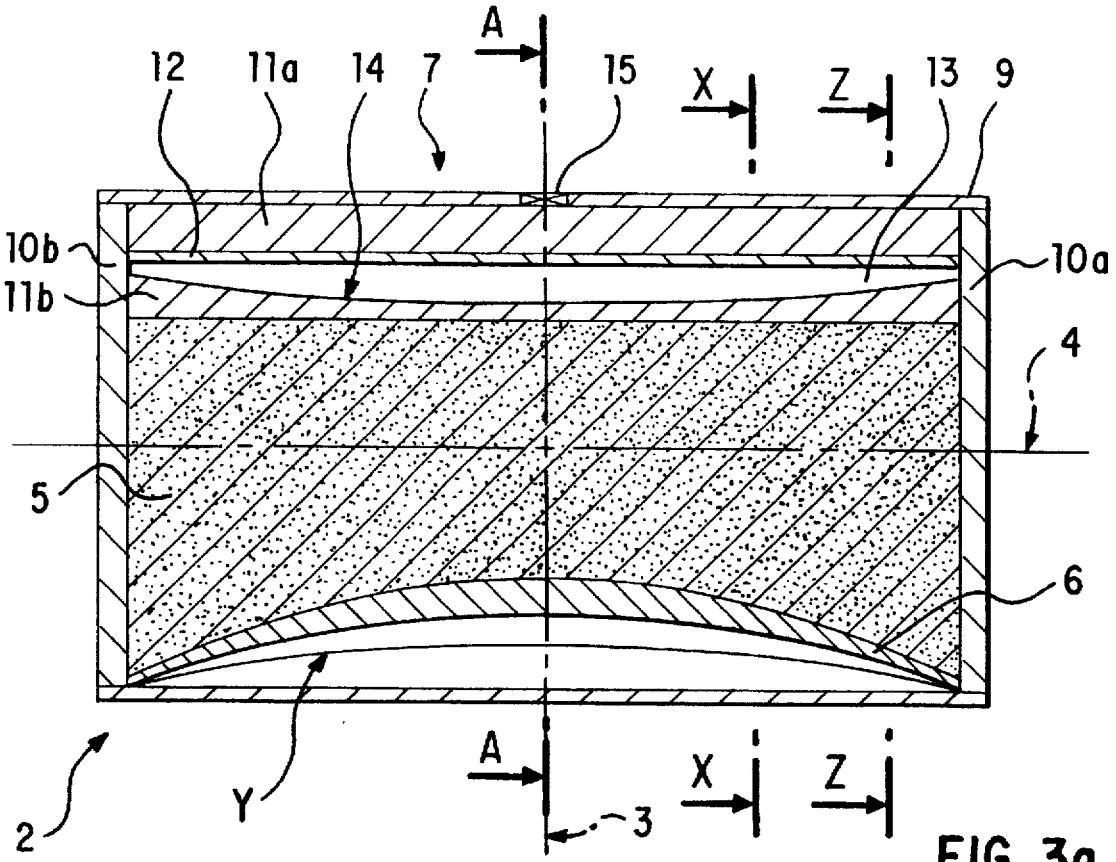
FIG. 3*a* is a lengthwise section through the warhead according to a first embodiment of the invention (the path of the sectioning plane is labeled BB in FIG. 3*b*)
Figure 3B:
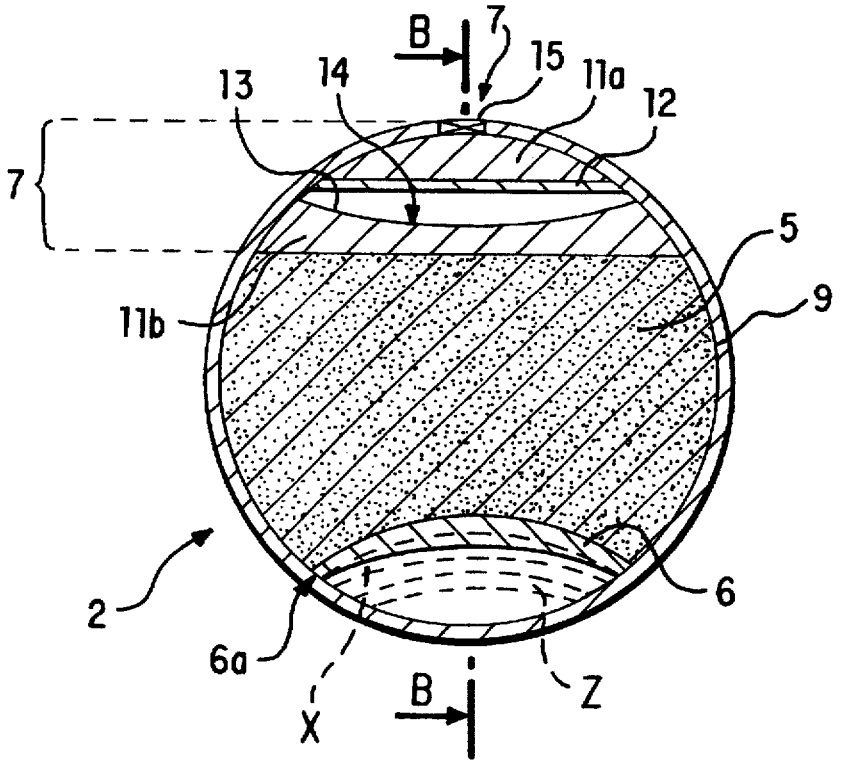
FIG. 3*b* is a section through this warhead along the plane labeled AA in FIG. 3*a;*

FIGS. 3*a* and 3*b* show a first embodiment of a warhead according to the invention in greater detail. Warhead 2 comprises a cylindrical envelope 9 made for example of composite material (wound filament). The axis of this envelope is essentially coincident with lengthwise axis 4 of the munition. Envelope 9 is closed at each end by plugs 10*a*, 10*b* (made of plastic or aluminum alloy, the plugs being joined to envelope 9 by gluing, for example). Envelope 9 contains an explosive charge 5 comprising a concave cap to which a covering 6 is applied, the charge being intended to be triggered by the triggering means. The triggering means comprises a detonator 15 as well as a plane wave generator (11*a*, 12, 11*b*).

Triggering mechanism 7 is located in the vicinity of cylindrical envelope 9 of the warhead and on the other side of axis 4 relative to covering 6. This arrangement of the triggering mechanism 7 makes it possible to orient the detonation wave that is intended to shape the covering in a direction that is radial overall throughout the assembly of the explosive charge. All of the energy furnished by the charge thus contributes to the shaping of the covering, and the effectiveness of the charge is optimal.

The plane wave generator, in known fashion, comprises a donor explosive 11*a*, a receiver explosive 11*b*, and a projected plate 12. The receiver explosive 11*b* comprises a concave receiving surface 14 located opposite plate 12. Detonator 15 is located essentially at mid-length in envelope 9 and its direction of action is coincident with the desired direction of action 3 of the warhead. Detonator 15 triggers donor explosive 11*a*, causing plate 12 to be projected into cavity 13. Receiver explosive 11*b* is triggered by the impact of plate 12.

The geometry of receiving surface 14, the detonation characteristics of donor and receiver explosives 11*a*, 11*b*, as well as the weight of plate 12 and the material of which the plate is composed are chosen by the individual skilled in the art in such fashion that the detonation wave that propagates into explosive charge 5 is plane and parallel to axis 4 of the envelope and perpendicular to action direction 3. Such a determination is within the ability of the individual skilled in the art, referring for example to patent French Pat. No. 2,672,380, whose content is introduced here by reference, and which describes the principle of the plane wave generator and the methods for defining its structure.

The advantage of using a plane wave generator for triggering as the invention proposes is that it becomes easy to create a projectile on the basis of a covering and to do so regardless of the profile of the covering used. Thus, the remainder of the description will present various embodiments comprising coverings of very different shapes.

In this first embodiment, covering 6 has its convexity directed toward axis 4 of the envelope. In addition, covering 6 has a double convexity, a first convexity in a plane perpendicular to axis 4 of the envelope and a second convexity in a plane that passes through the axis of the envelope and contains direction of action 3. As shown in FIGS. 3*a* and 3*b*, covering 6 is delimited by surfaces such that when it is cut by planes perpendicular to the axis of envelope 4 (or by planes parallel to the plane containing the axis of the envelope and direction of action 3), it has a section such that the convexity of the covering is oriented toward the axis of envelope 4.

It is easy for the individual skilled in the art to define analytically the surfaces delimiting such a covering. It is sufficient to define two families of curves that determine the section of the covering in different planes parallel to one another. A first family of curves is defined by planes perpendicular to axis 4 of the envelope. The second family of curves is defined by planes parallel to the plane containing the axis of the envelope and direction of action 3. For example, FIG. 3*b* shows curves X and Z of sections of covering 6 that correspond to two section planes XX and ZZ in FIG. 3*a*. FIG. 3*a* also shows curve Y, corresponding to edge 6*a* of covering 6 in contact with envelope 9.

It will be apparent that the shape of receiving surface 14 of the plane wave generator has a geometric definition similar to that of covering 6. It is a surface that has a double concavity: a first concavity in a plane perpendicular to axis 4 of the envelope and a second concavity in a plane containing axis 4 of the envelope and direction of action 3. The thickness of the covering will preferably be chosen to increase between its peripheral edge 6*a* in contact with envelope 9 and its center (located at the intersection of the covering and direction of action 3).

When it is triggered, explosive charge 5 causes deformation of covering 6 which destroys the wall of envelope 9. The type of deformation of the covering is analogous to that seen in core generator charges that have symmetry of revolution around their direction of action. The covering thus forms an elongate core with the front constituted by the median part of the covering and the rear by the edge of the covering. This core is projected toward a target at a speed on the order of 2000 m/s.

Depending on the desired performance (energy, projectile/target distance), various types of materials can be used to make the covering. The covering can be made of iron, copper, tantalum, nickel, or a non-metallic material, such as plastic (Nylon) or glass, for example. From the standpoint of manufacturing, the various components are obtained by machining, using numerically controlled machines programmed with the parameters of the various surfaces to be produced.

Thus, the explosive charge and the various components of the plane wave generator are machined. The assembly is then formed by gluing together the plane wave generator, the covering, and the charge, and the assembly is then placed inside cylindrical envelope 9. Sealing plugs 10*a* and 10*b* are attached last, together with detonator 15. For example, a warhead whose envelope 9 is 120 mm in diameter and 300 mm in length could be installed in a munition with an inside diameter of 120 mm. Such a charge has a power similar to that of a cylindrical core generator charge with an axis that coincides with the direction of action and has a diameter of 130–140 mm. The latter charge cannot be placed in the desired munition, which can only receive a cylindrical charge with a maximum diameter of 80 mm. Thus the invention makes it possible to equip a given munition with a warhead whose power is increased by almost 100%.

Figure 4A:
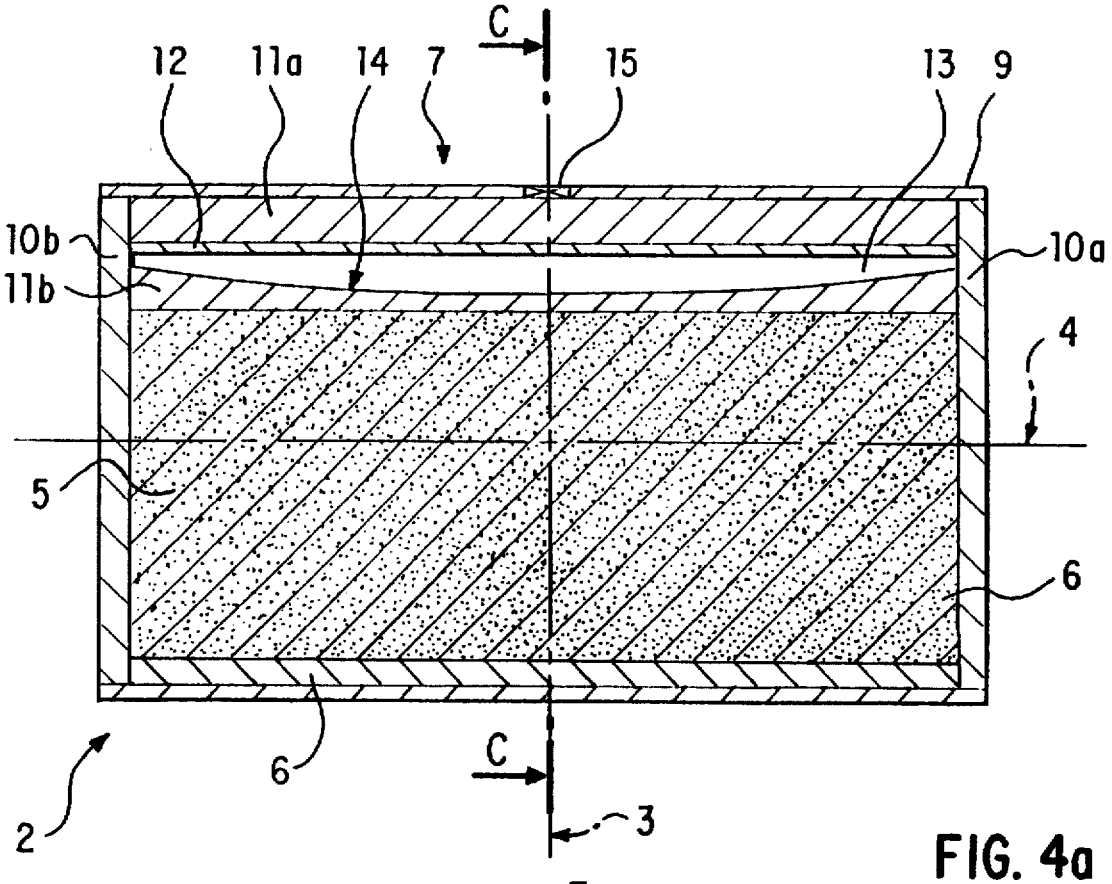
FIG. 4*a* is a lengthwise section through a warhead according to a second embodiment of the invention (the path of the sectioning plane is labeled DD in FIG. 4*b*)
Figure 4B:
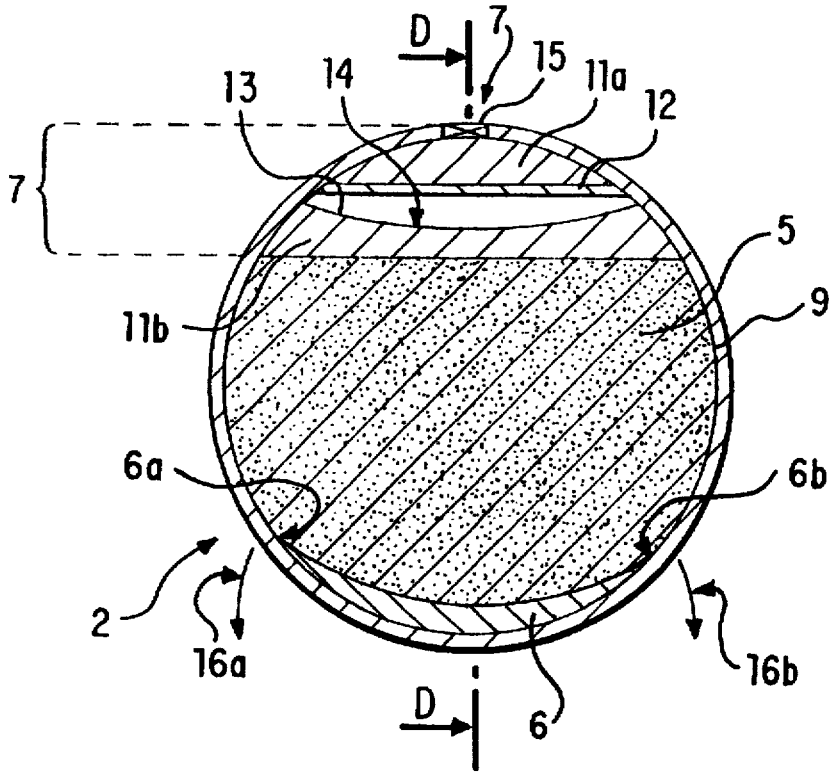
FIG. 4*b* is a section through this warhead along the plane whose path is labeled CC in FIG. 4*a;*

FIGS. 4*a* and 4*b* show a second embodiment of a warhead according to the invention.

Warhead 2 once again comprises a cylindrical envelope 9 made for example of a composite material whose axis is essentially coincident with lengthwise axis 4 of the munition. Envelope 9 is sealed at each end by plugs 10*a*, 10*b*, joined to the envelope by gluing, for example. The triggering mechanism 7 comprises a detonator 15 as well as a plane wave generator (11*a*, 12, 11*b*).

This embodiment differs from the previous one in that covering 6 is located against envelope 9 and its concavity is directed towards axis 4 of the envelope. This covering is delimited by surfaces with straight generatrices which are parallel to the axis of the envelope. It is, therefore, easier to manufacture than the covering described previously with reference to FIGS. 3*a* and 3*b*.

The external surface of covering 6 in this case is applied against the internal surface of the envelope, thus improving the mechanical strength of the warhead and the envelope that protects the covering. The thickness of the covering is again chosen such that it increases between its rectilinear edges 6*a*, 6*b* and its center (located at the intersection of the covering and direction of action 3).

This warhead is equipped with a plane wave generator that has the same structure as the one described previously with reference to FIGS. 3*a* and 3*b*. Explosive charge 5 is triggered to cause the deformation of covering 6 which destroys the wall of envelope 9; lateral edges 6*a* and 6*b* of the covering are projected in directions 16*a* and 16*b* and come together again essentially in a plane defined by axis 4 and direction 3 and located ahead of the central part of the covering. Thus the covering forms a wedge- or hatchet-shaped elongate core which is projected toward a target at a speed on the order of 2000 m/s.

Depending on the desired performance (energy, projectile/target distance), various types of materials can be used to make the covering. The covering can be made of iron, copper, tantalum, nickel, or a non-metallic material, such as plastic (Nylon) or glass, for example.

From a comparative standpoint, the second embodiment of the invention (FIGS. 4*a*, 4*b*) makes it possible to use a covering weight that is greater as well as a larger quantity of explosive. The power of this warhead is thus potentially greater than that of the warhead according to the embodiment shown in FIGS. 3*a* and 3*b*. However, the wedge-shaped core that it produces has a certain width (approximately equal to the length of the envelope) and its aerodynamic stability is less. The range of this warhead is thus reduced. The warhead according to the first embodiment (FIGS. 3*a*, 3*b*) on the other hand makes it possible to create a core whose geometry is more compact and closer to that of a bar (width or radial dimension smaller than the length of envelope 9), so that its stability in flight is better and it can be launched at greater distances from the target.

Figure 5A:
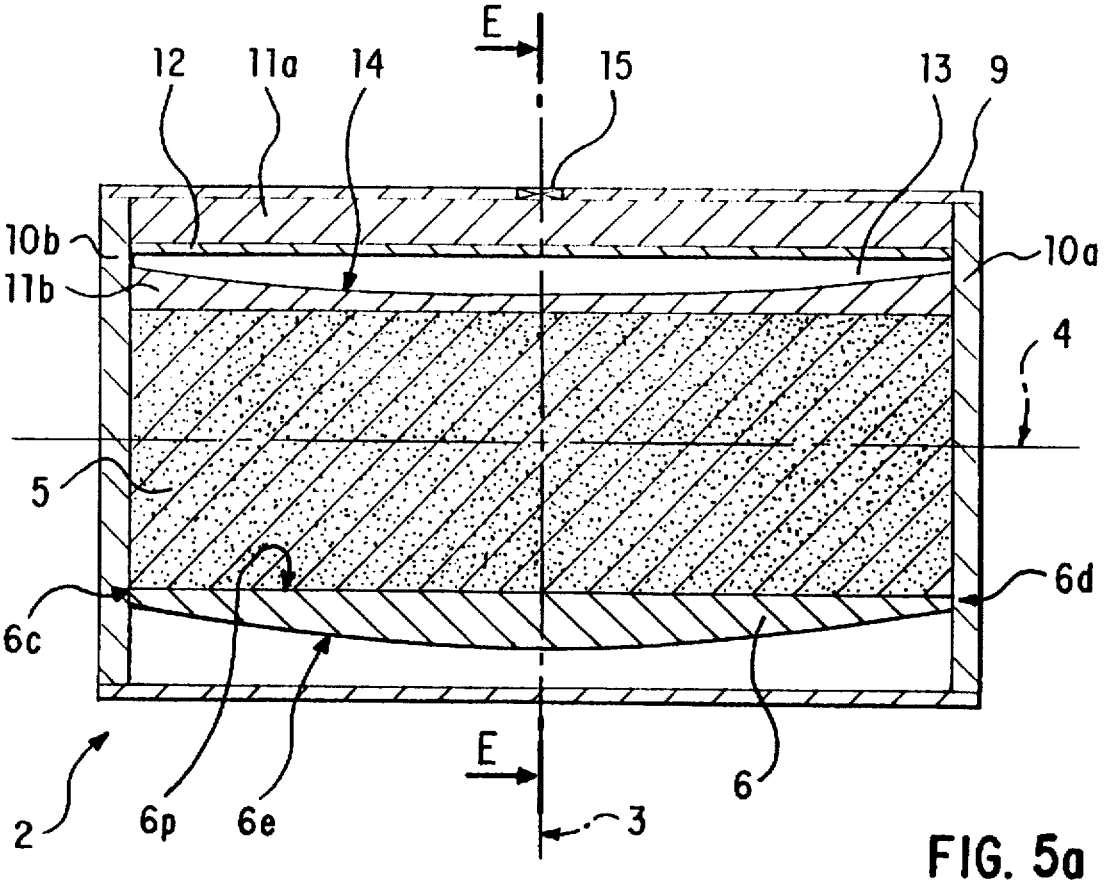
FIG. 5*a* is a lengthwise section through a warhead according to a third embodiment of the invention (the path of the sectioning plane is labeled FF in FIG. 5*b*)
Figure 5B:
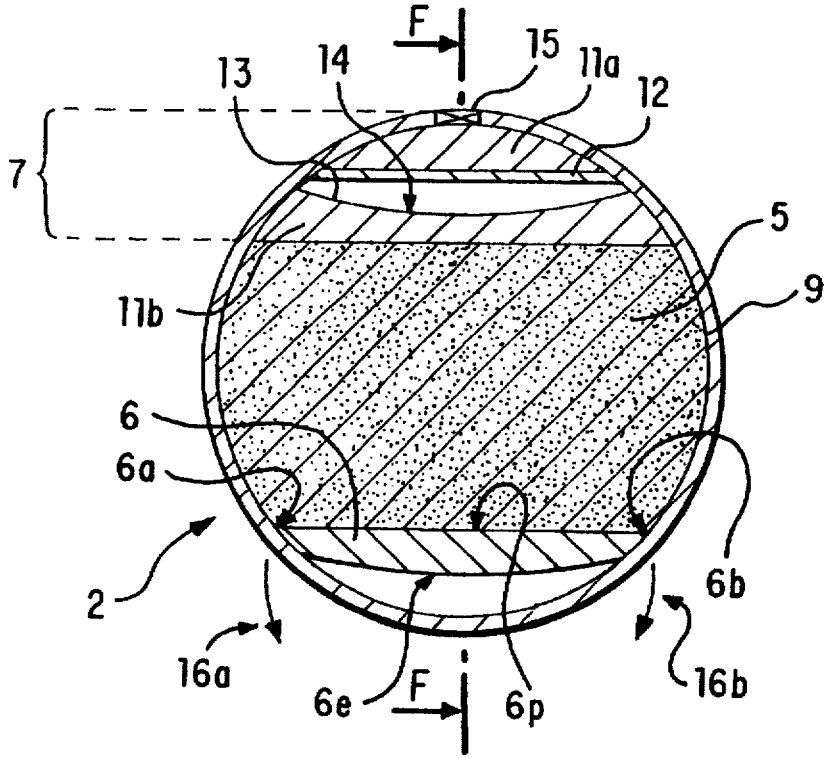
FIG. 5*b*is a section through this warhead along the plane whose path is labeled EE in FIG. 5*a;*

FIGS. 5*a* and 5*b* show a third embodiment of a warhead according to the invention.

Triggering means 7 once again comprises a plane wave generator (11*a*, 12, 11*b*).

This embodiment differs from the previous one by the shape of covering 6 which in this case has a plane face 6*p* in contact with the explosive. The advantage of such a shape is that it simplifies the machining of the explosive and covering. The covering is attached to the explosive by gluing.

The thickness of the covering is again chosen to increase between its rectilinear edges 6*a* and 6*b* and its center (located at the intersection of the covering and direction of action 3). The thickness similarly increases between edges 6*c* and 6*d* in contact with end plugs 10*a*, 10*b* and the center of the covering. Thus the covering has a plane face (6*p*) and a face (6*e*) that has a double convexity: one convexity in the plane perpendicular to axis 4 of the envelope and a second convexity in the plane that passes though axis 4 of the envelope and contains direction of action 3.

When explosive charge 5 is triggered, the covering is deformed in a manner similar to that of the covering shown in FIGS. 4*a* and 4*b*. Lateral edges 6*a* and 6*b* of the covering are projected in directions 16*a* and 16*b* and join again essentially at the level of a plane defined by axis 4 in direction 3 and in front of the central part of the covering. The covering thus forms an elongate wedge-shaped or hatchet-shaped core which is projected toward a target at a speed on the order of 2000 m/s.

Depending on the desired performance (energy, projectile/target distance) different types of materials can be used to make the covering. The covering can be made of iron, copper, tantalum, nickel, or a non-metallic material, such as plastic (Nylon) or glass, for example.

Figure 6A:
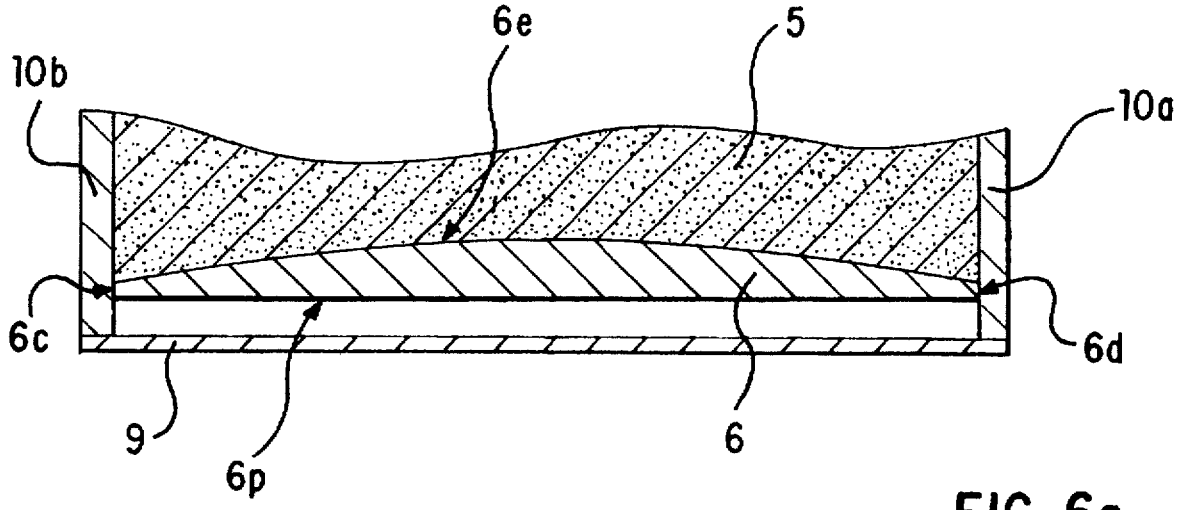
FIGS. 6*a* and 6*b* are partial views of a variation on this latter embodiment.
Figure 6B:
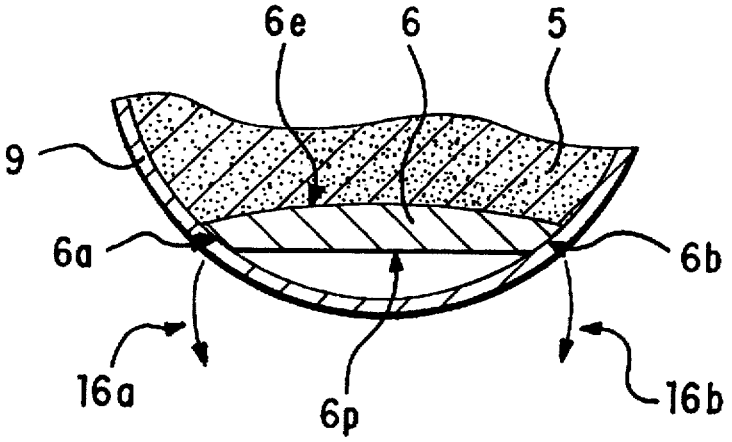

FIGS. 6*a* and 6*b* show in part a variation on this embodiment in which biconvex face 6*e* is in contact with explosive 5.

Figure 7A:
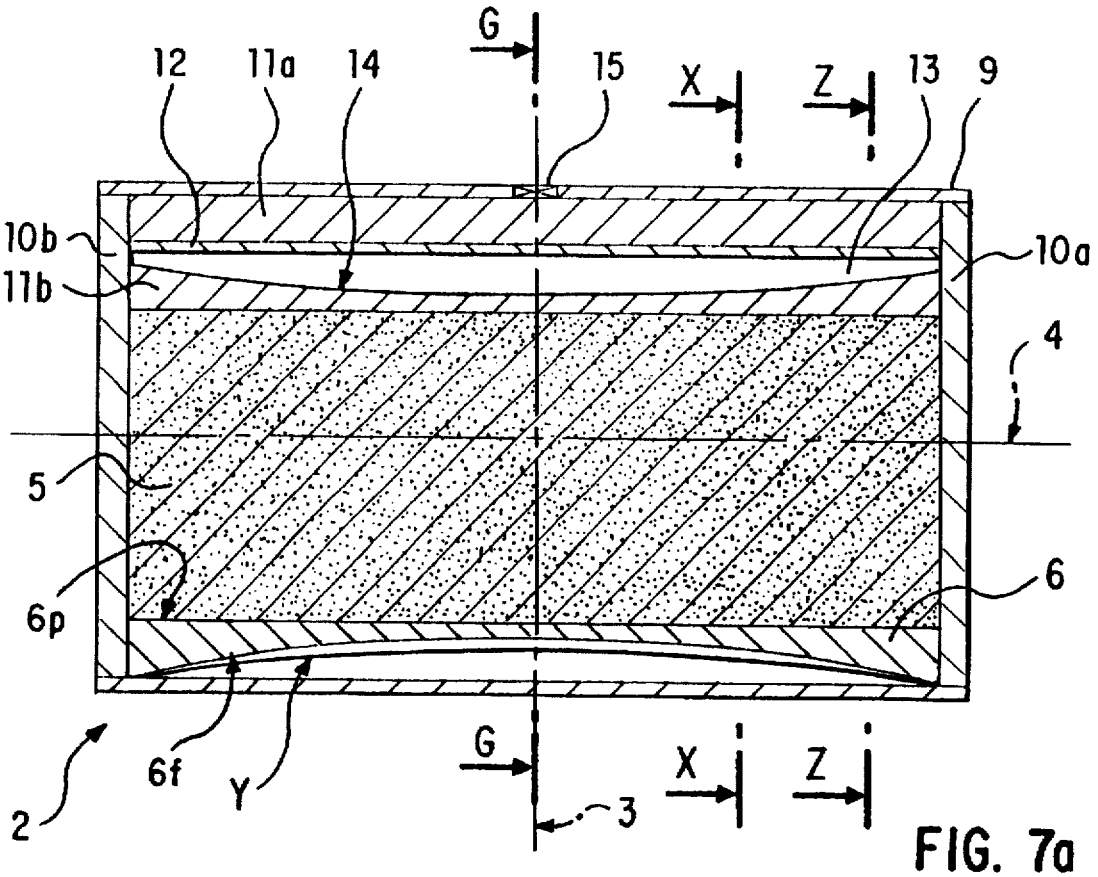
FIG. 7*a* is a lengthwise section through a warhead according to a fourth embodiment of the invention (the path of the sectioning plane is labeled HH in FIG. 7*b*)
Figure 7B:
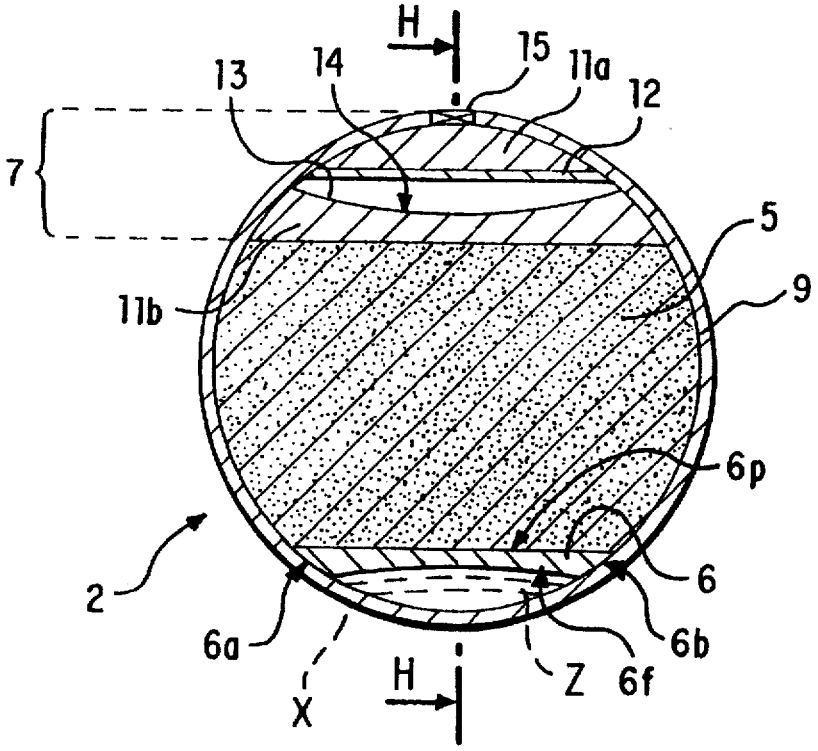
FIG. 7*b* is a section through this warhead along the plane whose path is labeled GG in FIG. 7*a*.

FIGS. 7*a* and 7*b* show a fourth embodiment of a warhead according to the invention.

Triggering mechanism 7 again comprise a plane wave generator (11*a*, 12, 11*b*) and will not be described in greater detail.

According to this embodiment, covering 6 comprises a plane face 6*p* in contact with explosive charge 5, simplifying machining. The other face of the covering has a concave surface 6*f* whose concavity is directed toward the exterior of warhead 1. The surface has a double concavity. It has a first concavity in a plane perpendicular to axis 4 of the envelope and a second concavity in a plane passing through the axis of the envelope.

In a manner similar to the covering of the embodiment in FIGS. 3*a* and 3*b*, covering 6 is delimited in this case by surfaces such that when it is cut by planes perpendicular to that of envelope 4 (or even by planes parallel to the plane containing the axis of the envelope and direction of action 3) it has a section such that the concavity of face 6*f* faces the exterior of envelope 4.

It is easy for the individual skilled in the art to define analytically the surfaces delimiting such a covering. For this purpose, it is sufficient to define two families of curves that determine the section of the covering in different planes parallel to one another. The first family of curves is that defined by the planes that are perpendicular to axis 4 of the envelope. The second family of curves is defined by the planes that are parallel to the plane that contains the axis of the envelope and direction of action 3. For example, FIG. 7*b* shows curves X and Z of the sections of covering 6 that correspond to two planes with sections XX and ZZ in FIG. 7*a*. FIG. 7*a* likewise shows curve Y corresponding to edge 6*a* of covering 6 in contact with envelope 9.

Because of this particular design, covering 6 has a thickness that decreases from its periphery that is most remote from the direction of action toward a center that is closest to the direction of action. As a result, when the warhead is triggered, a speed is achieved for the central part of the covering that is greater than that of the peripheral part.

This warhead thus makes it possible to create an elongate projectile whose configuration resembles that of a hollow-charge jet. This jet has a front part (head of the jet) propelled at a speed between 2500 m/s and 3500 m/s (formed by the central part of the covering) and followed by a slower core (1500 to 2500 m/s) formed by the peripheral part of the covering. The speeds obtained being greater, this warhead has perforation capabilities greater than those of the previous embodiments. However, it can be fired only at a shorter distance from the target (less than 100 times the diameter of the warhead).

Depending on the desired performance (energy, projectile/target distance), different types of materials can be used to make the covering. The covering can be made of iron, copper, tantalum, or nickel or a non-metallic material, such as plastic (Nylon) or glass, for example.

Different variations are possible without departing from the framework of the invention. Thus it is possible to replace the wave generator having a plate projection with a plane wave generator that uses a screen to shape the detonation wave or a generator comprising a plurality of triggers distributed over the envelope in such fashion that the combination of their effects makes it possible to obtain a quasi-plane detonation wave. It is also possible, in order to improve the stability of the warhead during acceleration, to place a compressible foam in cavity 13 of the plane wave generator.

What is claimed is:

1. A shaped-charge warhead, in a munition having a longitudinal axis, said munition comprising:

an envelope housed in the munition extending along the longitudinal axis and having a cylindrical shape extending along the longitudinal axis;

an explosive charge housed in the envelope and extending along the longitudinal axis;

a trigger for detonating the explosive charge, said trigger being positioned adjacent a periphery of the explosive charge and comprising a detonator and a substantially plane wave generator; and a singe piece covering housed in the envelope at the periphery of the explosive charge and movable in a direction of action perpendicular to the longitudinal axis by the detonation of the explosive charge, said covering positioned adjacent an opposite side of the explosive charge from said trigger.

2. The warhead of claim 1, wherein said covering has a convexity directed toward the longitudinal axis of the munition.

3. The warhead of claim 2, wherein said covering has a double convexity, a first convexity in a plane perpendicular to the longitudinal axis of said munition and a second convexity in a plane passing through the longitudinal axis of said munition and the direction of action.

4. The warhead of claim 2, wherein said covering has a plane face facing externally of said munition.

5. The munition of claim 2, wherein said covering has a concavity directed externally of said warhead.

6. The warhead of claim 1, wherein said covering has a concavity directed toward the longitudinal axis of said munition.

7. The warhead of claim 6, wherein said covering is delimited by surfaces with straight generatrices that are parallel to the longitudinal axis of said munition.

8. The warhead of claim 1, wherein said covering includes a plane face facing the longitudinal axis of said munition.

9. The warhead of claim 1, wherein said covering is delimited by surfaces with straight generatrices that are parallel to the longitudinal axis of said munition.

10. The warhead of claim 8, wherein said covering comprises a concave face directed towards the exterior of the warhead.

11. The warhead of claim 10, wherein said concave face has a double concavity, a first concavity in a plane perpendicular to the longitudinal axis of said munition and a second concavity in a plane that passes through the longitudinal axis of said munition and the direction of action.

12. The warhead of claim 8, wherein said covering further includes a convexity directed towards the exterior of said munition.

13. The warhead of claim 12, wherein said convexity has a double convexity, a first convexity in a plane perpendicular to the longitudinal axis of said munition and a second convexity in a plane that passes through the longitudinal axis of said munition and the direction of action.

14. The warhead of claim 1, wherein a thickness of said covering decreases towards a center of said covering.

15. The warhead of claim 1, wherein a thickness of said covering increases towards a center of said covering.

16. The warhead of claim 1, wherein said substantially plane wave generator includes a plate projection.

17. The warhead of claim 1, wherein said covering is made of one of iron, copper, tantalum and nickel.

18. The warhead of claim 1, wherein said envelope is made of a composite material.

19. A shaped-charge warhead, in a munition having a longitudinal axis, said warhead comprising:

a cylindrical envelope mounted in the munition having a longitudinal axis coincident with the longitudinal axis of the munition;

an explosive charge mounted in the cylindrical envelope and extending along the longitudinal axis of the munition and the envelope;

a triggering means positioned adjacent a periphery of said explosive charge for detonating the explosive charge and comprising a detonator and a substantially plane wave generator; and a single piece covering positioned adjacent the periphery of the envelope on an opposite side of the explosive charge from said triggering means, wherein said covering moves by detonation of the explosive charge in a direction perpendicular to the longitudinal axes of the munition and the envelope.

* * * * *